US006055668A

United States Patent [19]

Gros et al.

[11] Patent Number: 6,055,668

[45] Date of Patent: May 2, 2000

[54] POST-SURGICAL GARMENT

[76] Inventors: Melinda Gros, 320 Riverside Dr., New York, N.Y. 10025; Donna Lew, 17 Baldwin Ave., Massapequa, N.Y. 11758

[21] Appl. No.: 09/187,786

[22] Filed: Nov. 7, 1998

[51] Int. Cl.[7] ..... A41B 1/00

[52] U.S. Cl. ..... 2/69; 450/1

[58] Field of Search ..... 2/69, 104, 105, 2/106, 113, 115, 102, 108, 94, 114; 450/1, 3, 5, 8, 11, 12, 17, 23, 82, 28, 89, 83, 87, 84; 602/19

[56] References Cited

U.S. PATENT DOCUMENTS

| | | | |
|---|---|---|---|
| 4,106,121 | 8/1978 | Belson | 2/102 |
| 4,369,526 | 1/1983 | Clutts | 2/94 |
| 5,398,340 | 3/1995 | Kibbee | 2/102 |
| 5,427,563 | 6/1995 | Manning | 458/83 |
| 5,429,593 | 7/1995 | Matory | 602/79 |
| 5,454,119 | 10/1995 | Thomm | 2/114 |
| 5,465,425 | 11/1995 | Crispin | 2/102 |
| 5,538,502 | 7/1996 | Johnstone | 602/19 |
| 5,708,978 | 1/1998 | Johnsrud | 2/102 |

*Primary Examiner*—Gloria M. Hale
*Attorney, Agent, or Firm*—Michael I. Kroll

[57] ABSTRACT

The present invention discloses a post-surgical garment for use following breast or chest surgery wherein the garment 10 has straps 16 having a length of hook and loop material attached at overlapping ends 18 whereby an individual user 12 drapes the garment 10 over the shoulders and extends the back straps 16 down the front where the ends of the mating shoulder straps 16 are secured with hook and loop material 18 at a comfortable user selectable length which may be about half way between the top of the patient's shoulders and the patient's breasts. The main body of the garment 10 being open in the center and also having overlapping ends having a length of hook and loop material attached thereon, is secured at the front 14. Another length of hook and loop material 20 is located along the hem of the garment which acts as means for attaching a number of attachable and detachable bags 22 provided as means for holding other collection devices 28, bags or, e.g., a chemotherapy pump, depending on the therapy, or are themselves collection bags and each bag having a strap 23 permanently attached thereon to the external surface of the bag and having a length of hook and loop material 25 located on each end of the strap 23 whereby each strap can retain a number of tubes 30 passing between the bag and the point of surgery on the patient's body. Also located on the inner/rear of the garment 10 within the cup area 34 of the garment is a pocket 36 for inserting and retaining a prosthesis when applicable.

14 Claims, 5 Drawing Sheets

POST-SURGICAL GARMENT

BACKGROUND OF THE INVENTION

1. Field of the Invention

The present invention relates generally to surgical garments and, more particularly, to a post-surgical garment to be worn about the patient's upper body for use following breast or chest surgery wherein the garment straps have a length of hook and loop material attached at the ends whereby an individual drapes the garment over the shoulders and extends the back straps down the front where the ends of the mating shoulder straps are secured at a comfortable user selectable length. The main body of the garment being open in the center, also having a length of hook and loop material attached thereon, is secured at the front. Another length of hook and loop material is located along the hem of the garment which acts as means for attaching a number of attachable and detachable bags provided as means for holding other collection bags or a chemotherapy pump, depending on the therapy, or are themselves collection bags. The bags may have a strap permanently attached thereon to the external surface of the bag and having a length of hook and loop material located on each end of the strap whereby each strap can retain a number of tubes passing between the bag and the point of surgery. Also located within the area of the garment where a woman's breast would be located is a pocket for inserting and retaining a prosthesis when applicable.

2. Description of the Prior Art

There are garments which are available as post-surgical gowns and while they may be suitable for the purposes for which they were designed, they would not be as suitable for the present invention as hereinafter described.

U.S. Pat. No. 5,152,741

Inventor: Frank Farnio

Issued: Oct. 6, 1992

A surgical dressing is constructed of a chest-encircling flexible band formed primarily of a stretchable material with free overlapping ends that engage each other between the breasts of a person about which the dressing has been wrapped. The band includes differential support structure to provide more support for the sides of the user as compared with the remainder of the person about which the band has been wrapped.

It is thus desirable to provide a post surgical garment wherein the means for closure are located in the front of the garment. It is further desirable to provide said garment with a pocket located on the inside of the cup area for the purposes of inserting and retaining a prosthesis. It is still further desirable to provide said post-surgical garment with a number of attachable and detachable bags wherein a number of collection bags or pump holding bags, depending on the therapy, can be placed or they themselves may act as collection bags each having a strap for holding a number of tubes connected between the bag and the surgery.

SUMMARY OF THE PRESENT INVENTION

The present invention discloses a post-surgical garment for use following breast or chest surgery wherein the garment has straps having a length of hook and loop material attached at overlapping ends whereby an individual user drapes the garment over the shoulders and extends the back straps down the front where the ends of the mating shoulder straps are secured with hook and loop material at a comfortable user selectable length. The main body of the garment being open in the center and also having overlapping ends having a length of hook and loop material attached thereon, is secured at the front. Another length of hook and loop material is located along the hem of the garment which acts as means for attaching a number of attachable and detachable bags provided as means for holding other collection devices, bags or, e.g., a chemotherapy pump, depending on the therapy, or are themselves collection bags. Each bag can have a strap permanently attached thereon to the external surface of the bag having a length of hook and loop material located on each end of the strap whereby each strap can retain a number of tubes passing between the bag and the point of surgery on the patient's body. Also, optionally located on the inner/rear of the garment within the area of the garment where a woman's breast would be located can be a pocket for inserting and retaining a prosthesis when applicable.

A primary object of the present invention is to provide a post surgical garment having means for closure of said garment by any method found suitable for such purposes such as hook and loop material, hook and eyelets, buttons, snaps, frogs or zippers.

Another object of the present invention is to provide a post-surgical garment which provides access to the surgery without complete removal of said garment.

Yet another object of the present invention is to provide a post surgical garment wherein the means for closure is adjustable to accommodate varying sizes of individuals.

Still yet another object of the present invention is to provide a post surgical garment having pockets located in cup area for the insertion and retention of a prosthesis.

Another object of the present invention is to provide a post surgical garment having a means for attaching a number of collection bags or pump holding bags.

Yet another object of the present invention is to provide a post surgical garment with a number of attachable and detachable bags which can be used for holding a number of collection bags or act as collection bags or can hold various pumps, depending on the medical therapy.

Still yet another object of the present invention is to provide a post surgical garment with a number of attachable and detachable bags each having a strap as means for securing a number of tubes between the bag and the surgery.

Another object of the present invention is to provide a post surgical garment with a number of attachable and detachable bags which can be detached from the surgical garment and attached around any belt while washing or taking a shower by using the mating hook and loop material located on the exterior surface of the bag.

Additional objects of the present invention will appear as the description proceeds.

The present invention overcomes the shortcomings of the prior art by providing a post-surgical garment having means for closure of the garment at the front, means for inserting and retaining a prosthesis, means for attaching and detaching a number of surgical bags, means for securing drain tubes or similar tubes, and means for adjusting said garment to varying body sizes and medical therapies.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawing in which.

Figure 1:
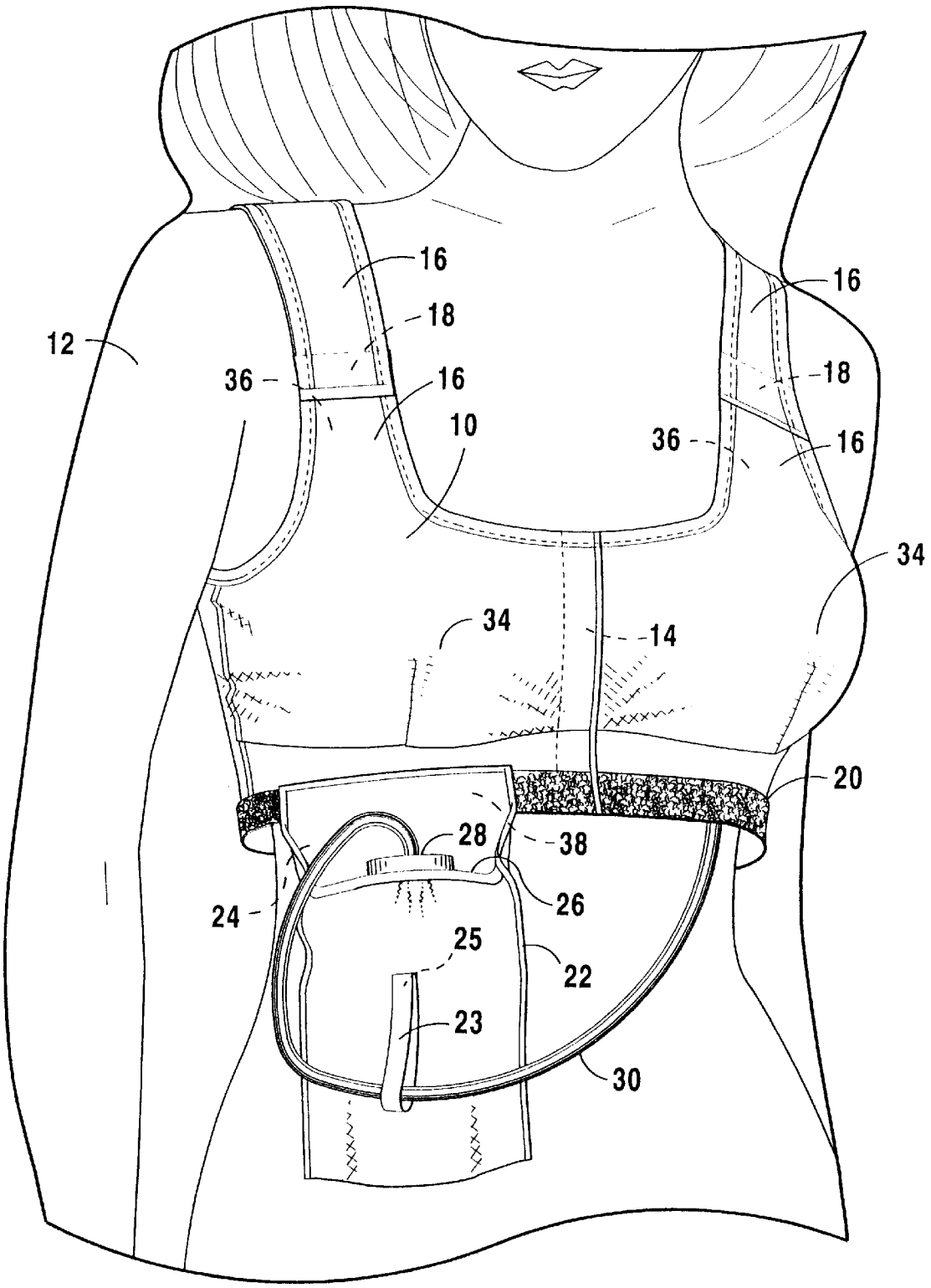
FIG. 1 is a perspective view of the present invention in use. Shown is the main body garment having a number of pieces of hook and loop material attached to the ends of the straps providing means for closure within the front of the garment. Also shown is a length of hook and loop material located along the hem of the garment providing means for attaching a number of collection bags or pump holding bags having mating hook and loop material located on the top edge of the bag.

With regard to the reference numerals, the following numbering is throughout the various drawings.

10 garment
12 user
14 closure means on front
16 straps
18 strap connector means
20 hem of garment
22 bag
23 bag strap
24 bag connection means
25 bag strap connection means
26 bag pouch
28 collection device
30 tube for collection device
32 belt
34 cups
36 inner cup pockets
38 loop in bag

DESCRIPTION OF THE PREFERRED EMBODIMENT(S)

Turning to FIG. 1, therein is shown a perspective view of the present invention in use about the body of a user. Therein is shown the basic main body garment 10 of the present invention attached around the body of the user 12 having closure means 14 on the front of and between the breasts of the patient 12 the means having overlapping ends having hook and loop material or other suitable or like means. The garment 10 is equipped with a pair of straps 16 which travel over the front and back of the user and attach to each other at either end, by having either of the ends overlap each other with hook and loop material 18 about half way between the top of the patient's shoulders and the patient's breasts in order to hold the garment onto the body of the user at a comfortable user selectable length. In practice., it is anticipated that the front strap would close over the back strap and that the back strap would comprise the hook portion of the hook and loop material in order to prevent any hooks or the like from scratching the user's body. Shown along the outer bottom edge of the garment is a hem of exposed hook and loop material 20 upon which various pockets or bags 22 may be attached. The bag 22 is equipped with hook and loop material 24 at its upper edge for placement or attachment to the hem 20 of the garment. The bag 22 is further equipped with a strap 23 attached thereon to the external surface of the bag and having a length of hook and loop material 25 located on each end of the strap 23 whereby each strap can retain a number of tubes 30 passing between the bag and the point of surgery or other desired point. The bags 22 also have a pouch 26 for holding any of a variety of collection devices 28. Also shown therein is a drain tube 30 for transporting fluids for collection devices, running through the strap 23 from the collection device 28 to the area of surgery or area of use by the patient user. The garment 10 has cups 34 which have inner cup pockets 36 on the inner/rear surface of the garment for holding, for example, a prosthesis. Note that while cups 34 are shown, the device could be made with or without cups 34, and, if, for example, men used the device, no cups or inner pockets 36 would be placed in the area of the breasts.

Figure 2:
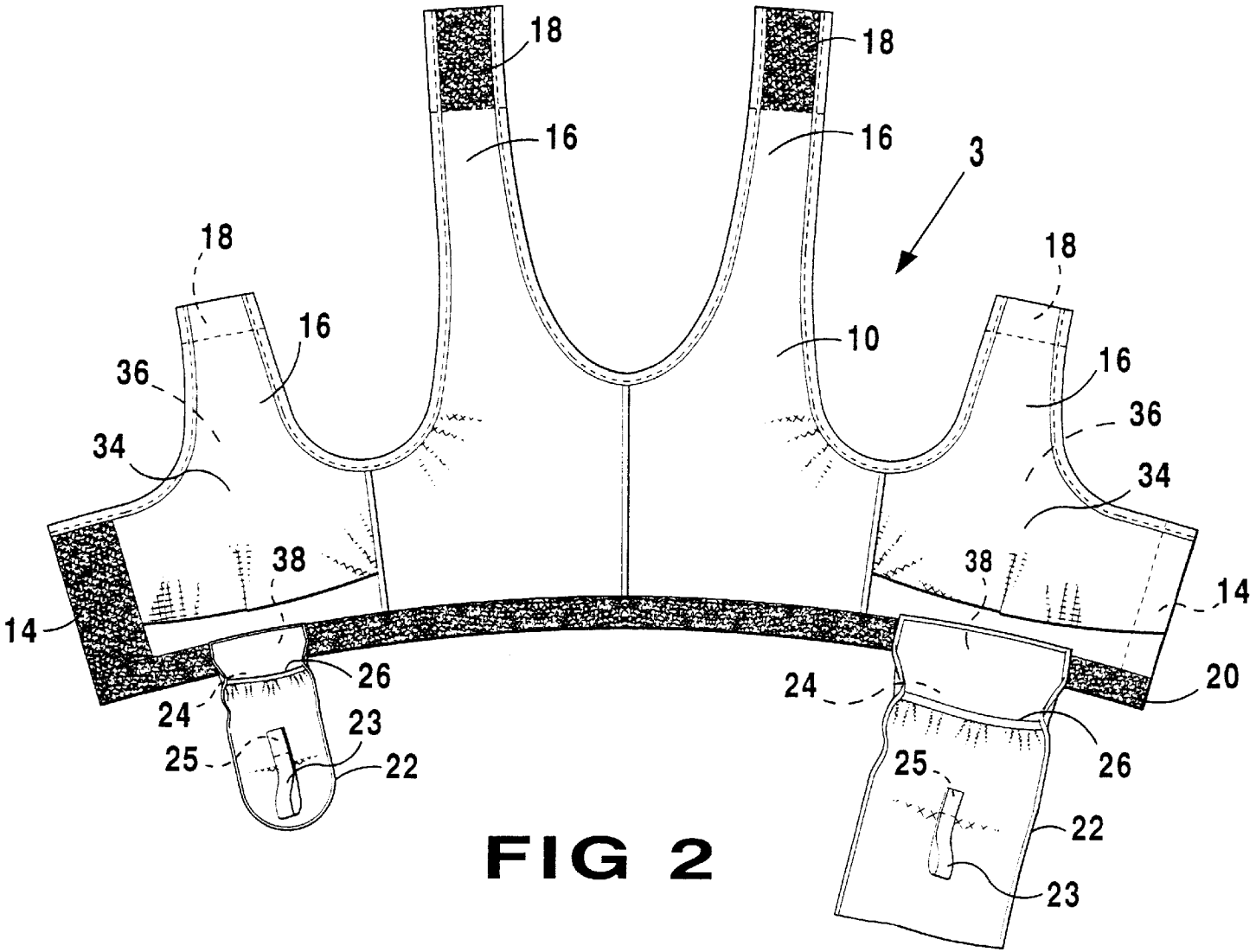
FIG. 2 is a front elevation view of the present invention. Shown is the main body garment having a number of pieces of hook and loop material attached to the ends of the straps and on the front closure as well as to the hem of the garment wherein a number of collection bags can be attached.

Turning to FIG. 2, therein is shown a front elevation view of the present invention. Therein is shown the basic main body garment 10 of the present invention with its front closure means 14. The garment 10 is equipped with straps 16 which travel over the front and back of the user and attach to each other with hook and loop material 18 in order to hold the garment onto the body of the user. Shown along the bottom of the garment is a hem of hook and loop material 20 upon which various pockets or bags 22 are attached. The bags 22 are equipped with hook and loop material 24 at the upper edges for placement or attachment to the hem 20 of the garment. Also shown is the bag strap 23 and bag pouch 26.

Figure 3:
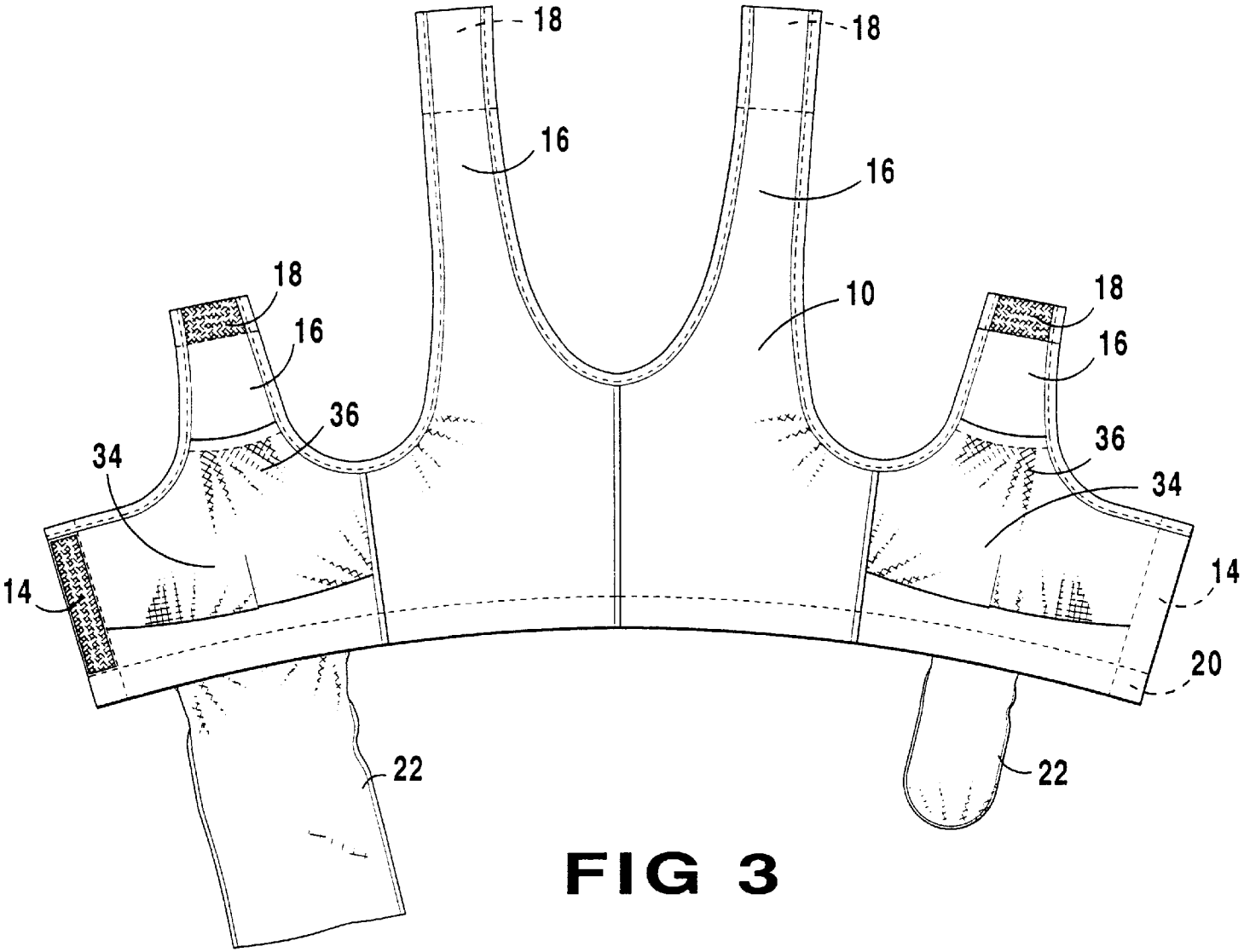
FIG. 3 is a rear elevation view of the present invention. Shown is the main body garment having pockets located in the cup area for the insertion and retention of a prosthesis. Also shown are the mating pieces of hook and loop material for the straps and main body of the garment.

Turning to FIG. 3, therein is shown a rear or inner surface elevation view of the present invention. Therein is shown the basic main body garment 10 of the present invention with its front closure means 14, the straps 16, and strap attaching means 18. Shown in outline along the bottom of the garment is a hem of hook and loop material 20 upon which the various pockets or bags 22 are attached. The pockets 36 on the inner/rear of the cups 34 are also shown.

Figure 4:
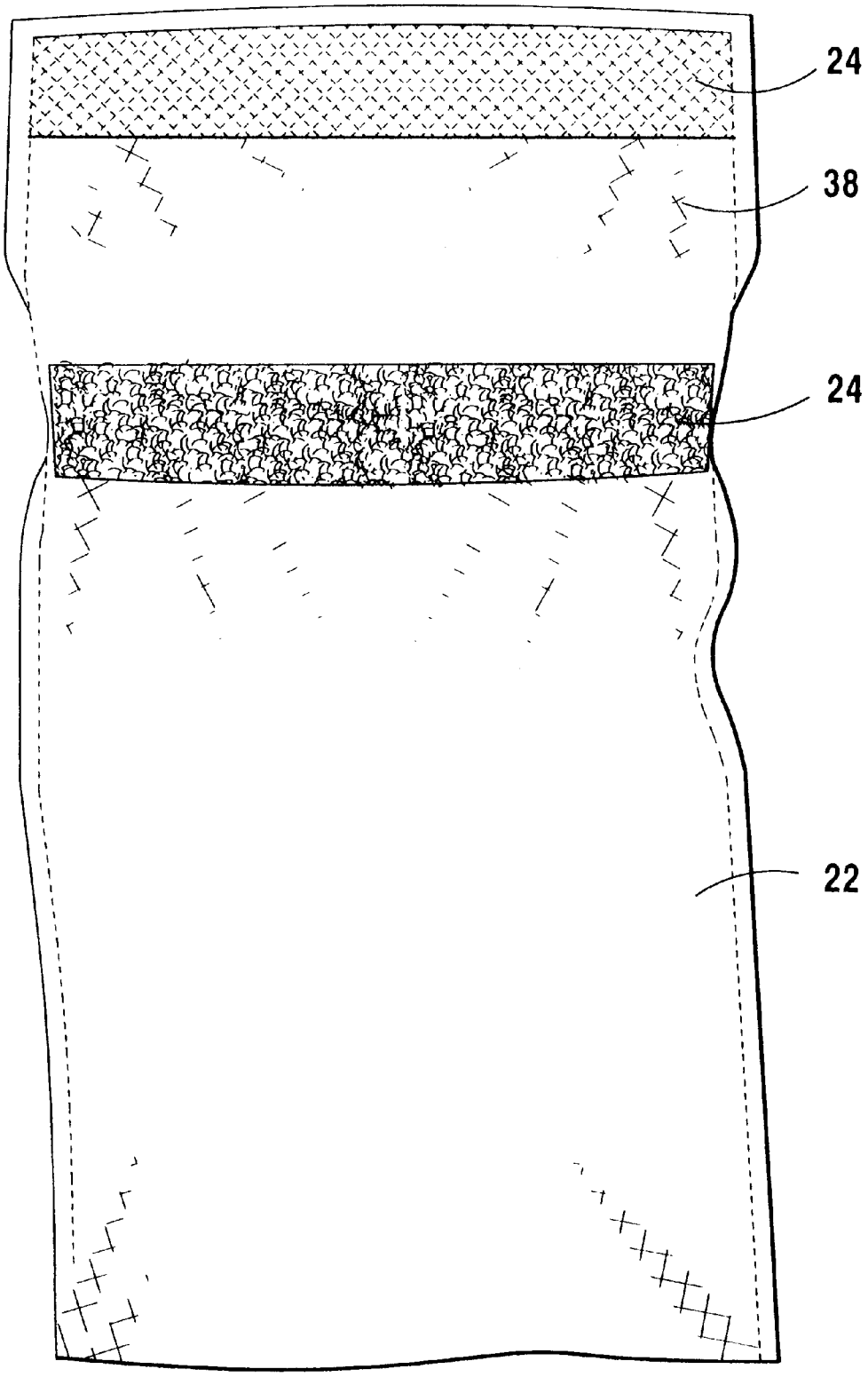
FIG. 4 is a rear elevation of a collection bag of the present invention whereupon two mating strips of hook and loop material have been attached to the bag wherein said bag can be removed from said garment and folded upon itself to form a loop for attachment to a belt.

Turning to FIG. 4, therein is shown a rear elevation view of a collection bag for use with the present invention. Therein is shown the bag 22, having two mating strips of hook and loop material 24 attached near the upper end of the bag. In operation the bag can be removed from the garment (not shown) and the hook and loop material 24 can then be folded back upon itself to form a loop (not shown) in the area of the bag denoted 38 the loop being formed from the upper portion of the bag for attachment to a belt (not shown), which would be worn about the waist of the user. Note that the hook and loop material 24 folds back upon itself below the area 38 where the belt would be, so that the loop formed from the upper portion of the bag in the area 38 is formed around the belt.

Figure 5:
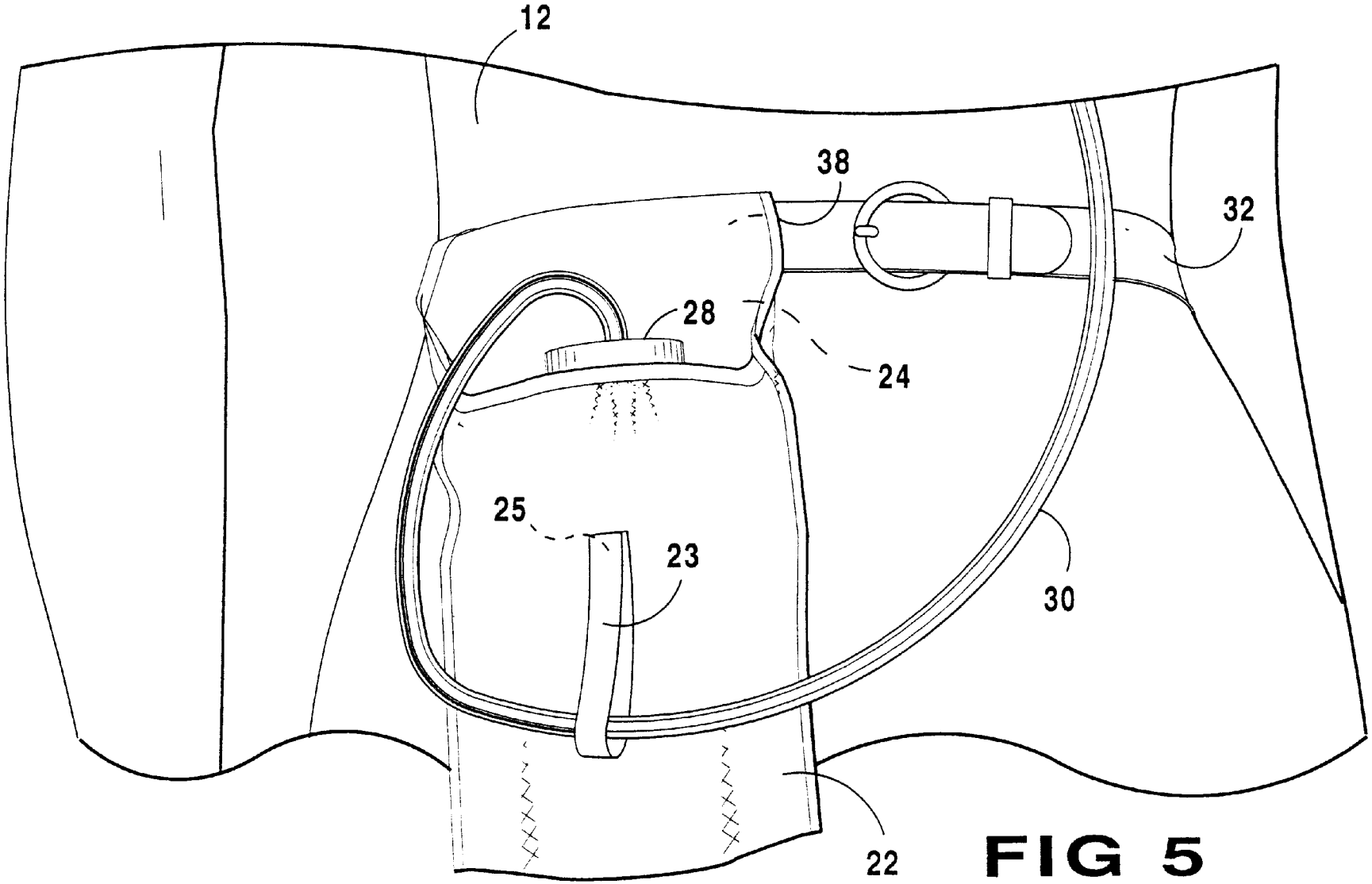
FIG. 5 is a front elevation of an individual having removed a collection bag from the surgical garment for the purposes of washing or taking a shower and has attached said collection bag containing a collection bottle with attached tube to a belt by using the hook and loop material located on the bag to form a loop thereby providing means for attachment to the belt.

Turning to FIG. 5, therein is shown a front elevation of a user 10 having removed the collection bag 22 from the surgical garment (not shown) for the purposes of, e.g., washing or taking a shower, and has attached the collection bag 22 containing a collection bottle 28 with strap 23 and drain tube 30 for collection devices, with the bags attached to a belt 32 by using the hook and loop material 24 located on the bag to form a loop 38 through which the belt 32 can pass thereby providing a means for attachment to the belt 32.

Concerning the uses, materials and methods of construction of the present invention, which may be made with or without the cups 34, the cups 34 and pocket 36 may be made by darting the fabric or, e.g., by seams, molding and shirring. The closure means 14 and 18 could be hook and loop or, e.g., hook and eyes, buttons, zippers, snaps or frogs. Also, it is possible that the entire length of the straps could be made having VELCRO applied thereto so that the VELCRO could stick to itself at any point on the entire length of the straps. The bags 22 could be attached to the hem 20 with hook and loop or, e.g., buttons or snaps, and furthermore, the bags 22 could be made of cloth or other suitable material, e.g., plastic or like material. Also, the belt 32 could be attached to the waist, arm, or leg of the patient, and, the bat, strap connection means 25 could be hook and loop material, or, e.g., buttons or snaps. Also note that the device may be used for other than surgical applications, which, by way of example, could include a vest for fishermen which could have removable bags for holding fishing flies and related items.

I claim:

1. An apparatus for holding articles, comprising:

(a) a garment sized for use by humans;

(b) said garment being open at its front center;

(c) closure means being provided on the front of said garment to secure said garment to the body of the user;

(d) a pair of straps for draping said garment about the body of the user;

(e) said pair of straps having connecting means for connecting to each other over the shoulders of the user in order to drape the garment about the upper body of the user;

(f) said garment having a pair of cups for holding the breasts of the user;

(g) said pair of cups having a pocket on their inner surface for receiving a prosthesis;

(h) a hem being provided along the outer lower extremity of the garment; and, (i) said hem comprised of connecting means whereby various receiving elements are connected to said hem.

2. The apparatus of claim 1 wherein said pair of straps connect to each other about half way between the top of the user's shoulders and the user's breasts.

3. The apparatus of claim 1, further comprising a bag having connecting means on its upper extremities whereby said bag is attached to said hem.

4. The apparatus of claim 3, wherein said closure means and said connecting means further comprise hook and loop material.

5. The apparatus of claim 3, wherein said bag is comprised of cloth material.

6. The apparatus of claim 3, wherein said bag is comprised of plastic material.

7. The apparatus of claim 3, wherein said closure means and said connecting means further comprise buttons.

8. An apparatus for holding articles, comprising:

(a) a garment sized for use by humans;

(b) said garment being open at its front center;

(c) closure means being provided on the front of said garment to secure said garment to the body of the user;

(d) a pair of straps for draping said garment about the body of the user;

(e) said pair of straps having connecting means for connecting to each other over the shoulders of the user in order to drape the garment about the upper body of the user;

(f) said garment having a pocket on its inner surface for receiving a prosthesis;

(g) said pocket being located in the area of the breasts of the user;

(h) a hem being provided along the outer lower extremity of the garment; and, (i) said hem comprised of connecting means whereby various receiving elements are connected to said hem.

9. The apparatus of claim 8, wherein said pair of straps connect to each other about half way between the top of the user's shoulders and the user's breasts.

10. The apparatus of claim 8, further comprising a bag having connecting means on its upper extremities whereby said bag is attached to said hem.

11. The apparatus of claim 10, wherein said closure means and said connecting means further comprise hook and loop material.

12. The apparatus of claim 10, wherein said bag is comprised of cloth material.

13. The apparatus of claim 10, wherein said bag is comprised of plastic material.

14. The apparatus of claim 10, wherein said closure means and said connecting means further comprise buttons.

* * * * *